US005785022A

United States Patent [19]

Haboush, II et al.

[11] Patent Number: 5,785,022

[45] Date of Patent: Jul. 28, 1998

[54] FUEL INJECTOR POST

[75] Inventors: William P. Haboush, II, Orion, Mich.; Roger E. Pressler, Waterloo, Ind.; Rainer G. Plamper, Huntington Woods, Mich.

[73] Assignee: Epic Technical Group, Inc., Auburn Hills, Mich.

[21] Appl. No.: 864,362

[22] Filed: May 28, 1997

[51] Int. Cl.[6] ..... F02M 41/00; F02M 55/02

[52] U.S. Cl. ..... 123/456; 123/470

[58] Field of Search ..... 123/456, 468, 123/469, 470

[56] References Cited

U.S. PATENT DOCUMENTS

| | | | |
|---|---|---|---|
| 2,978,870 | 4/1961 | Vdoviak | 60/39.74 |
| 3,194,221 | 7/1965 | Dinger et al. | 123/32 |
| 3,402,703 | 9/1968 | Dickerson et al. | 123/32 |
| 4,286,563 | 9/1981 | Fahim et al. | 123/469 |
| 4,519,371 | 5/1985 | Nagase et al. | 123/470 |
| 4,693,223 | 9/1987 | Eshleman et al. | 123/468 |
| 4,771,751 | 9/1988 | Haigh et al. | 123/470 |
| 4,909,221 | 3/1990 | Heuser | 123/470 |
| 4,938,193 | 7/1990 | Raufeisen et al. | 123/470 |
| 5,024,198 | 6/1991 | Usui | 123/470 |
| 5,035,224 | 7/1991 | Hornby et al. | 123/456 |
| 5,058,555 | 10/1991 | Haboush, II et al. | 123/470 |
| 5,070,844 | 12/1991 | Daly | 123/456 |
| 5,074,269 | 12/1991 | Herbon et al. | 123/456 |
| 5,111,794 | 5/1992 | DeGrace, Jr. | 123/470 |
| 5,123,399 | 6/1992 | Motoyama et al. | 123/531 |
| 5,152,269 | 10/1992 | Murphy | 123/470 |
| 5,176,121 | 1/1993 | Kennedy | 123/470 |
| 5,197,435 | 3/1993 | Mazur et al. | 123/456 |
| 5,203,304 | 4/1993 | Hafner et al. | 123/456 |
| 5,238,192 | 8/1993 | McNair | 239/575 |
| 5,299,542 | 4/1994 | Hafner | 123/470 |
| 5,301,647 | 4/1994 | Lorraine | 123/470 |
| 5,372,113 | 12/1994 | Smith | 123/470 |
| 5,390,638 | 2/1995 | Hornby et al. | 123/456 |
| 5,394,850 | 3/1995 | Murphy et al. | 123/470 |
| 5,398,656 | 3/1995 | Brisbane et al. | 123/470 |
| 5,419,297 | 5/1995 | Peterson, Jr. et al. | 123/470 |
| 5,513,613 | 5/1996 | Taylor et al. | 123/456 |

*Primary Examiner*—Thomas N. Moulis
*Attorney, Agent, or Firm*—Pennie & Edmonds LLP

[57] ABSTRACT

The present invention relates to a fuel injector post for connecting a fuel injector to a fuel rail. The fuel injector post comprises a tubular body portion with a central axis having a circumferential wall, an open end and an outlet on the tubular body portion. The fuel injector post further comprises an adapter portion positioned at an angle to the central axis of the tubular body and integral with the outlet on the tubular body portion. The adapter portion has a passage in fluid communication with the tubular body portion and the fuel rail and therefore connects a fuel injector to the side of a fuel rail, which is advantageous to the engine package. Alternatively, the tubular body portion can have a closed end configured and adapted to reduce air entrapment in the tubular body portion to therefore reduce or eliminate pressure waves in the entire fuel system due to entrapped air.

18 Claims, 3 Drawing Sheets

FUEL INJECTOR POST

FIELD OF THE INVENTION

The present invention relates to a fuel injector post for receiving a fuel injector and connecting the same to the main fuel tube of a fuel rail assembly. In particular, the present invention relates to a fuel injector post having a traversing inlet integrated with its main tubular body. The present invention also relates to a fuel injector cup which has a slant closed end for reducing air trapped inside the fuel injector post near the closed end.

BACKGROUND OF THE INVENTION

Fuel injector-receiving sockets are commonly used for receiving fuel injectors and connecting the same to the main fuel tube of a fuel rail assembly. A typical fuel injector-receiving socket has a cylindrical body that is open at both its top and bottom ends. The open top end of the socket provides for a fuel injector, such as a bottom-feed fuel injector, to be inserted into and removed from the socket while the open bottom end allows the fuel injector nozzle to be placed in communication with an intake manifold runner that leads to an engine cylinder. There are an inlet and an outlet provided on the sidewall of the cylindrical body for passing pressurized fuel through the injector-receiving socket. The injector-receiving socket is further formed with inner shoulders for properly locating the fuel injector therein.

When the fuel injector is properly seated in the injector-receiving socket, an upper O-ring seal that is disposed around the outside of the fuel injector above the inlet provides sealing contact with the socket sidewall to prevent fuel from leaking through the open top of the socket, and a lower O-ring seal that is disposed around the outside of the fuel injector below the inlet provides sealing contact with the socket sidewall to prevent fuel leakage from the open bottom of the socket. These two O-ring seals form top and bottom boundaries of a fuel zone of the socket that receives pressurized fuel through a main fuel tube that serves fuel to one or more such sockets. The fuel inlet port of each installed fuel injector is exposed to this fuel zone in the socket in order to receive pressurized fuel.

These injector-receiving sockets are usually arranged below the main fuel tube of the fuel rail assembly to connect with the same. It is understood that such an arrangement takes significant space in the engine and thus can increase the entire volume of the engine package. Further, in a conventional injector-receiving socket, it often happens that air is entrapped in a pocket above the outlet inside the socket. This remaining air acts as an "echo chamber" and can increase "injector click" noise and undesired pressure waves in the entire fuel system.

It is therefore desirable to provide a fuel injector post which can connect the fuel injector to the side of the main fuel tube of the fuel rail assembly for the benefit of reducing the volume of engine package. It is also desirable to provide a fuel injector cup being configured and adapted to reduce air entrapment in the fuel injector cup to therefore reduce or eliminate pressure waves in the entire fuel system due to entrapped air. The present invention provides one such design which meets all these requirements.

SUMMARY OF THE INVENTION

The present invention relates to a fuel injector post for connecting a fuel injector to a fuel rail. The fuel injector post comprises (A) a tubular body portion having a central axis and a circumferential wall, an open end for connection to a fuel injector, and an outlet associated with the circumferential wall, and (B) an adapter portion positioned at an angle with respect to the central axis of the body portion for connection to the side of a fuel rail. The adapter portion is integral with the outlet of the tubular body portion to provide a passage in fluid communication between the tubular body portion and the fuel rail.

The circumferential wall comprises an inner shoulder for positioning the fuel injector relatively to the tubular body portion. The inner shoulder divides the tubular body portion into a first portion adjacent to the open end for receiving the injector and a second portion adjacent to the closed end. The outlet on the tubular body portion is located on the second portion.

In a preferred embodiment of the present invention, the open end of the tubular body portion is flared to facilitate the insertion of the fuel injector into the fuel injector post and has a circular flange curved outwardly from and opposite to the open end.

The adapter portion of the fuel injector post can have a tubular shape with a central axis intersecting with that of the tubular body portion at an angle $\alpha$ of between about 15° and 150°, preferably between 30° and 120° and more preferably 30° and 90°. More specifically, the angle $\alpha$ can be of about 30°, 45°, 60° or 90°. In a preferred embodiment of the present invention, the central axis of the adapter portion extends substantially perpendicularly to that of the tubular body portion.

The present invention also relates to a fuel injector cup for connecting a fuel injector to the main tube of the fuel rail which comprises (A) a tubular body portion having a central axis and a circumferential wall, a closed end, an open end for connection to a fuel injector, and an outlet associated with the circumferential wall, and (B) an adapter portion. At least part of the closed end is configured and adapted to reduce air entrapment in the tubular body portion above the outlet to therefore reduce or eliminate pressure waves in the entire fuel system due to entrapped air. The adapter portion is positioned at an angle $\alpha$ with respect to the central axis of the tubular body portion for connection to the main tube of the fuel rail. The adapter portion is connected to the outlet of the tubular body portion to provide a passage in fluid communication between the tubular body portion and the main fuel tube.

The circumferential wall of the tubular body has an inner shoulder for positioning the fuel injector relatively to the tubular body portion. The inner shoulder divides the tubular body portion into a first portion adjacent to the open end and a second portion adjacent to the closed end. The outlet of the tubular body portion is located on the second portion of the tubular body portion.

In a preferred embodiment of the present invention, at least part of the closed end is configured to have a wall portion that is at less than 90° with respect to the central axis to minimize the volume of the closed end. The closed end wall portion forms an angle with the central axis of the tubular body of between about 30° and 60°, and more preferably of about 45°. The closed end wall portion is curved to conform to the configuration of the fuel injector.

The adapter portion of the fuel injector cup is a separate component joined to the tubular body portion and has a central axis intersecting the central axis of the tubular body portion. In a preferred embodiment of the present invention, the adapter portion has a cylindrical body with its central axis extending substantially perpendicular to the central axis of the tubular body portion. Both ends of the adapter portion are stepped forming shoulders for positioning the adapter portion relatively to the outlet of the fuel injector cup and the main fuel tube.

BRIEF DESCRIPTION OF THE DRAWINGS

These and other features, aspects, and advantages of the present invention will become much more apparent from the following description, appended claims, and accompanying drawings, in which:

DETAILED DESCRIPTION OF THE PREFERRED EMBODIMENTS

Figure 1:
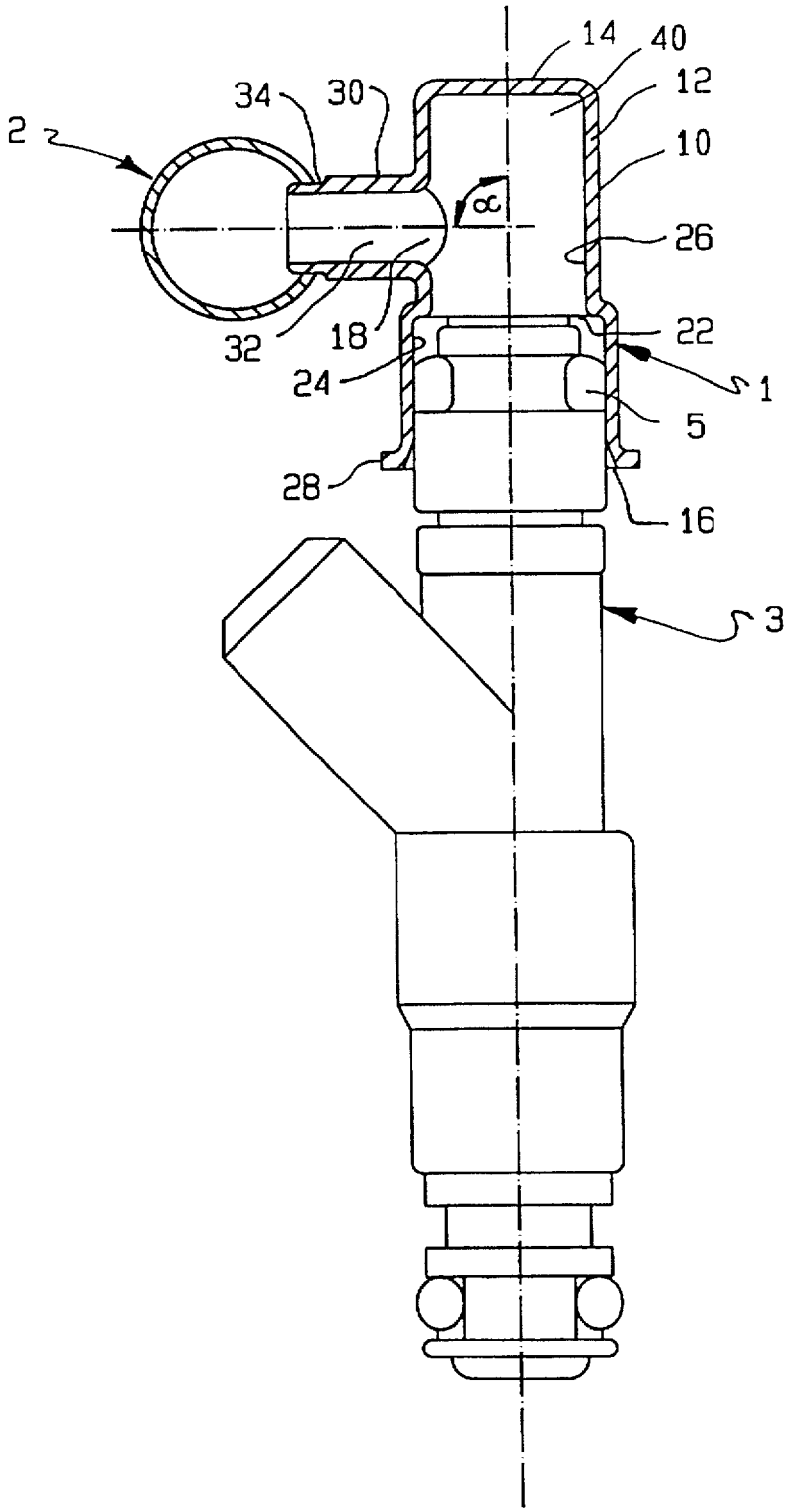
FIG. 1 is a cross-section of a first embodiment of a fuel injector post according to the present invention, which connects a fuel injector to the side of the main fuel tube of a fuel rail.

Various fuel injector posts or fuel injector cups embodying the principles of the present invention are illustrated in FIGS. 1–8. These fuel injector posts or cups can reduce the volume of engine package or pressure waves in the entire fuel system due to entrapped air. In each embodiment, the same elements are designated with the same reference numerals and repetitive description are omitted.

Referring to FIG. 1, a fuel injector post 1 of the present invention is shown joined to a main fuel tube 2 of a fuel rail assembly in a fluid-tight manner. The fuel injector post 1 also receives a fuel injector 3 and connects the same to the main fuel tube 2 of the fuel rail assembly. It is understood that the fuel injector post 1 and the fuel injector 3 are also joined in a fluid-tight manner, which avoids any fuel leakage at the joint. As shown in FIG. 1, an O-ring seal 5 is disposed around the outside of an end portion on the fuel injector 3 to provide sealing contact with the fuel inject post 1 in order to prevent fuel from leaking through the open end of the fuel injector post 1.

Additional details of the fuel injector post 1 are shown in FIGS. 2–5. The fuel injector post 1 comprises a tubular body portion 10 with a central axis. The tubular body portion 10 has a circumferential wall 12, a closed end 14 and an open end 16 through which the fuel injector 3 is inserted into and removed from the fuel injector post 1. The circumferential wall 12 comprises an outlet 18 provided thereon for connecting with an adapter portion 30 as described hereinafter. Detailed configuration of the tubular body portion 10 will be discussed later.

The fuel injector post 1 also comprises an adapter portion 30, which is preferably in a tubular shape. The adapter portion 30 is positioned at an angle α to the central axis of the tubular body portion 10. The angle a is defined between the central axis of the tubular body portion 10 and that of the adapter portion 30 as shown in the drawings and between but excluding 020 and 180°. In a preferred embodiment, the adapter portion 30 has a tubular shape with a central axis. The central axis of the adapter portion 30 intersects with that of the tubular body portion 10 at an angle α of between about 15° and 150°, preferably of between about 30° and 120°, and more preferably of between about 30° and 90°. Other preferred angles α are 30°, 45°, 60° and 90°. In a further preferred embodiment, the central axis of the adapter portion 30 extends substantially perpendicular to the central axis of the tubular body portion 10.

In the preferred embodiments shown in FIGS. 1–5, the adapter portion 30 is integrally formed with tubular body portion 10 at its outlet 18. The integral joint of the adapter portion 30 and the tubular body portion 10 can provide a smooth interior for the fuel injector post 1 and therefore reduces any undesired fluid disturbance inside the fuel injector post 1.

The adapter portion 30 has a passage 32 in fluid communication with both the tubular body portion 10 and the main fuel tube 2 of the fuel rail assembly (see FIG. 1). In this way, the fuel injector post 1 is capable of both accommodating at least a portion of the fuel injector 3 in its open end 16 and connecting the same to the side of the main fuel tube 2 of the fuel rail assembly via its adapter portion 30.

Figure 4:
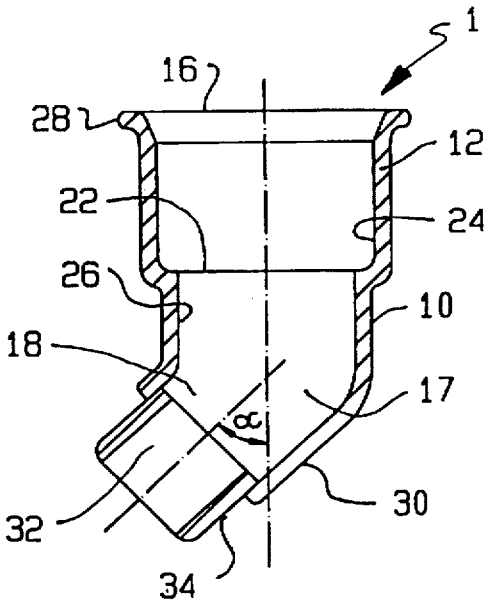
FIG. 4 is a cross-section of a third embodiment of the fuel injector post of the present invention.
Figure 5:
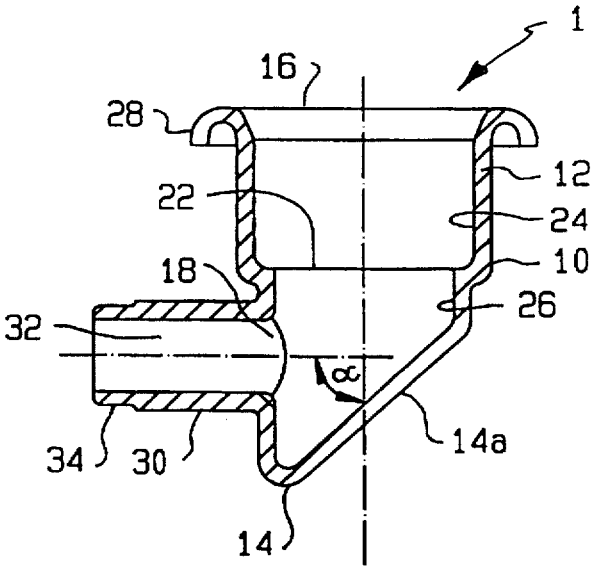
FIG. 5 is a cross-section of a fourth embodiment of the fuel injector post of the present invention.

Further, as shown in FIGS. 1, 4 and 5, the adapter portion 30 has its free end stepped. The stepped end 34 facilitates the insertion of the adapter portion 30 into the main fuel tube 2 of the fuel rail assembly and further assists the location of the adapter portion 20 relative to the main fuel tube 2.

The tubular body portion 10 can be constructed in various ways but still fulfill its function. In a preferred embodiment as illustrated in FIG. 1 and further in FIGS. 2 to 5, the circumferential wall 12 of the tubular body portion 10 is stepped to form an inner shoulder 22. The inner shoulder 22 divides the circumferential wall 12 of the tubular body portion 10 into a first portion 24 adjacent to the open end 16 for receiving the injector 3 and a second portion 26 adjacent to the closed end 14. The first portion 24 of the circumferential wall 12 preferably has a larger dimension than the second portion 26. Therefore, the inner shoulder 22 formed can assist in locating the fuel injector 3 in properly seated position when it is inserted into the tubular body portion 10.

In the embodiments shown in FIGS. 1–3 and 5, the outlet 18 of the tubular body portion 10 is provided on the circumferential wall 12 at the second portion 26 thereof. In an alternative embodiment shown in FIG. 4, the outlet 18 of the tubular body portion 10 is provided on the opposite side of the open end 16. Such arrangement is advantageous in avoiding the "dead area" 40 within the tubular body portion 10 as further discussed hereinafter.

Figure 2:
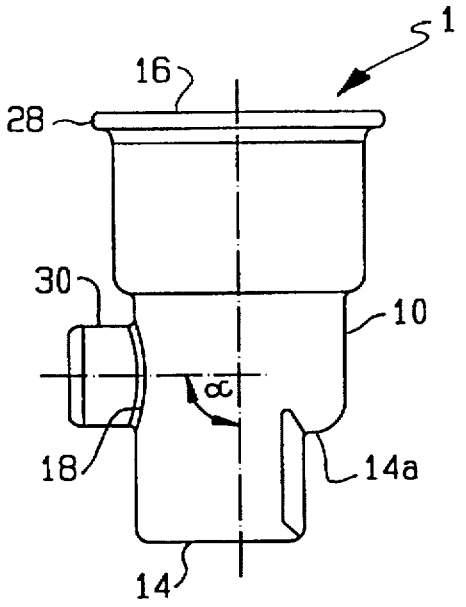
FIG. 2 is a front view of a second embodiment of the fuel injector post according to the present invention.
Figure 3:
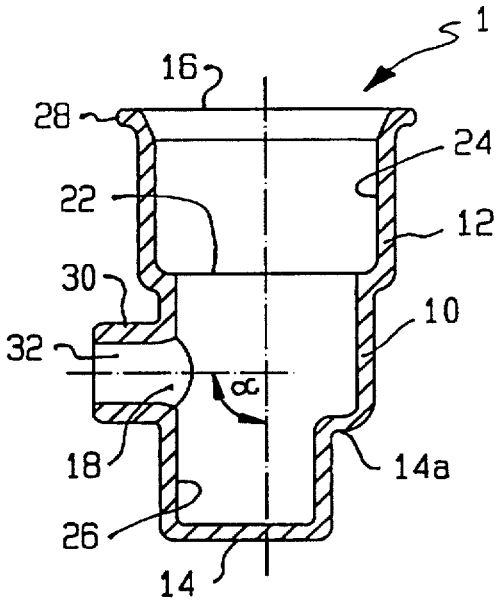
FIG. 3 is a cross-section of the fuel injector post shown in FIG. 2.

In the preferred embodiments shown in FIGS. 2, 3 and 5, the tubular body portion 10 has at least part of its closed end 14 configured and adapted to reduce air entrapment therein. More specifically, FIG. 2 and 3 show that the closed end 14 of the tubular body portion 10 is curved into a wall portion 14*a* to conform to the configuration of the fuel injector 3. Moreover, FIG. 5 shows that at least part of the closed end 14 of the tubular body portion 10 is configured to have a wall portion 14*a* that is at less than 90° with respect to the central axis to minimize the volume of the closed end 14. Preferably, the closed end wall portion 14*a* can form an angle with the central axis of the tubular body portion 10 of between about 30° and 60° and more preferably of about 45°.

All of the above-mentioned modifications made to the tubular body portion 10 can significantly reduce the "dead area" 40 formed between the central axis of the adapter 10 portion 30 and the closed end 14 of the tubular body portion (see FIG. 1) and therefore reduce or eliminate pressure waves in the entire fuel system due to entrapped air.

It is further preferred that the open end 16 of the tubular body portion 10 is made flared to therefore facilitate the insertion of the fuel injector 3 into the fuel injector post 1. In addition, the open end 16 of the tubular body portion 10 can comprise a circular flange 28 extended therefrom and curved outwardly from and opposite to the open end 16. Such flange 28 can serve different purposes such as facilitating the removal of the fuel injector post 1 from the connection with the fuel injector 3.

Figure 6:
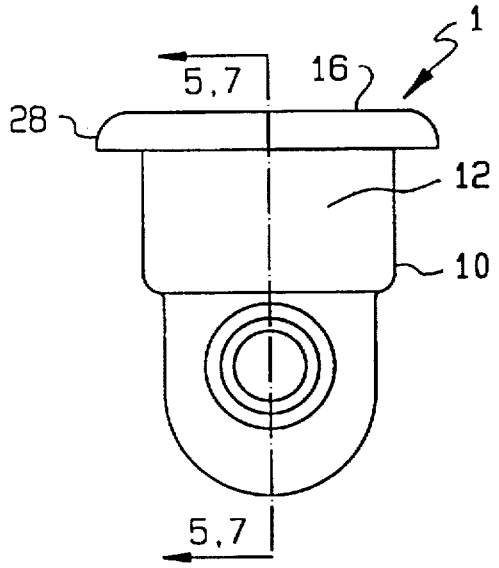
FIG. 6 is a side view of a fifth embodiment of the fuel injector cup according to the present invention.
Figure 7:
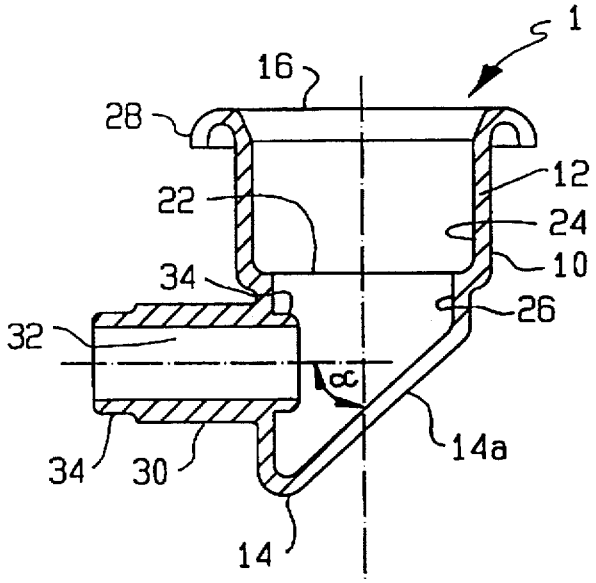
FIG. 7 is a cross-section of the fuel injector cup of FIG. 6 taken along line A—A.
Figure 8:
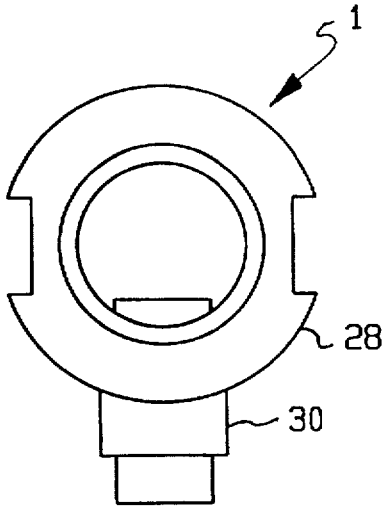
FIG. 8 is a top view of the fuel injector cup shown in FIG. 6.

FIGS. 6 to 8 show another fuel injector post 1 of the present invention. In this preferred embodiment, the fuel injector post 1 is in the form of a fuel injector cup 1, which is constructed similarly to the fuel injector post 1 discussed relating to the first embodiment.

In such a fuel injector cup 1, at least part of the closed end 14 is configured and adapted to reduce air entrapment in the tubular body portion 10 above the outlet 18 to therefore reduce or eliminate pressure waves in the entire fuel system due to entrapped air. In a preferred embodiment, at least part of the closed end 14 of the tubular body portion 10 is configured to have a wall portion 14*a* that is at less than 90° with respect to the central axis to minimize the volume of the closed end 14. More preferably, the closed end wall portion 14*a* forms an angle with the central axis of the tubular body portion 10 of between about 30° and 60°, and particularly about 45°. In an alternative embodiment, the closed end 14 of the tubular body portion 10 is curved into a wall portion 14*a*. The wall portion 14*a* conforms to the configuration of the fuel injector 3 (see FIGS. 2 and 3) to reduce the air entrapped in the tubular body portion 10.

An adapter portion 30 is connected at the outlet 18 on the circumferential wall 12 of the tubular body portion 10. In a preferred embodiment, the adapter portion 30 is a separate component joined to the tubular body portion 10 and has a central axis intersecting the central axis of the tubular body portion 10. The adapter portion 30 and the tubular body portion 30 are joined in a fluid-tight manner so that fuel passing the fuel injector cup 1 cannot leak out through their joint. In a further preferred embodiment, the adapter portion 30 has a tubular shape with its central axis extending substantially perpendicular to the central axis of the tubular body portion 10.

The adapter portion 30 can have both its ends stepped to form stepped ends 34. It is understood that so formed stepped ends 34 can both facilitate the insertion of the adapter portion 30 in and assist the position of the adapter portion 30 relatively to the outlet 18 of the fuel injector cup 1 and the outlet (not shown) of the main fuel tube 2.

The foregoing description is only illustrative of the principle of the present invention. It is to be recognized and understood that the invention is not to be limited to the exact configuration as illustrated and described herein. Accordingly, all expedient modifications readily attainable by one versed in the art from the disclosure set forth herein that are within the scope and spirit of the present invention are to be included as further embodiments of the present invention. The scope of the present invention accordingly is to be defined as set forth in the appended claims.

What is claimed is:

1. A fuel injector post for connecting a fuel injector to a fuel rail comprising (A) a tubular body portion having a central axis and a circumferential wall, an open end for connection to a fuel injector, and an outlet associated with the circumferential wall; and (B) an adapter portion positioned at an angle α with respect to the central axis of the body portion for connection to the side of a fuel rail, the adapter portion being integral with the outlet of the tubular body portion to provide a passage in fluid communication between the tubular body portion and the fuel rail.

2. The fuel injector post of claim 1, wherein the tubular body portion further comprises a closed end, at least part of the closed end being configured and adapted to reduce air entrapment in the tubular body portion above the outlet to therefore reduce or eliminate pressure waves in the entire fuel system due to entrapped air.

3. The fuel injector post of claim 1, wherein the circumferential wall comprises an inner shoulder for positioning the fuel injector relatively to the tubular body portion, the inner shoulder dividing the tubular body portion into a first portion adjacent to the open end for receiving the injector and a second portion adjacent to the closed end, the outlet on the tubular body portion being located on the second portion.

4. The fuel injector post of claim 1, wherein the open end of the tubular body portion is flared to facilitate the insertion of the fuel injector into the fuel injector post and comprises a circular flange curved outwardly from and opposite to the open end.

5. The fuel injector post of claim 1, wherein the adapter portion has a tubular shape with a central axis intersecting with that of the tubular body portion at an angle α of between about 15° and 150°.

6. The fuel injector post of claim 5, wherein angle α is between about 30° and 120°.

7. The fuel injector post of claim 5, wherein the angle α is between about 30° and 90°.

8. The fuel injector post of claim 5, wherein the angle α is between about 30° and 60°.

9. The fuel injector post of claim 5, wherein the angle α is about 45°.

10. The fuel injector post of claim 1, wherein the adapter portion has a tubular shape with a central axis extending substantially perpendicular to the central axis of the tubular body portion.

11. A fuel injector cup for connecting a fuel injector to the main tube of a fuel rail comprising (A) a tubular body portion having a central axis and a circumferential wall, a closed end, an open end for connecting to a fuel injector, and an outlet associated with the circumferential wall, with at least part of the closed end being configured and adapted to reduce air entrapment in the tubular body portion above the outlet to therefore reduce or eliminate pressure waves in the entire fuel system due to entrapped air; and (B) an adapter portion positioned at an angle α with respect to the central axis of the tubular body portion for connection to the main tube of a fuel rail, the adapter portion being connected to the outlet of the tubular body portion to provide a passage in fluid communication between the tubular body portion and the fuel rail.

12. The fuel injector cup of claim 11, wherein the circumferential wall is stepped to form an inner shoulder for positioning the fuel injector relatively to the tubular body portion, the inner shoulder dividing the tubular body portion into a first portion adjacent to the open end and a second portion adjacent to the closed end, the outlet being located on the second portion of the tubular body portion.

13. The fuel injector of claim 11, wherein at least part of the closed end is configured to have a wall portion that is at less than 90° with respect to the central axis to minimize the volume of the closed end.

14. The fuel injector cup of claim 13, wherein the closed end wall portion forms an angle with the central axis of the tubular body portion of between about 30° and 60°.

15. The fuel injector cup of claim 13, wherein the closed end wall portion forms an angle with the central axis of the tubular body portion of about 45°.

16. The fuel injector cup of claim 13, wherein the closed end is curved into a wall portion to conform to the configuration of the fuel injector.

17. The fuel injector cup of claim 11, wherein the adapter portion is a separate component joined to the tubular body portion and has a central axis intersecting the central axis of the tubular body portion.

18. The fuel injector cup of claim 17, wherein the adapter portion has a tubular shape with its central axis extending substantially perpendicular to the central axis of the tubular body portion.

* * * * *